US007142804B2

(12) United States Patent
Goto et al.

(10) Patent No.: US 7,142,804 B2
(45) Date of Patent: Nov. 28, 2006

(54) TONER, TONER CARTRIDGE THAT HOLDS THE TONER THEREIN, AND IMAGE FORMING APPARATUS INTO WHICH THE TONER CARTRIDGE IS ATTACHED

(75) Inventors: Takuya Goto, Tokyo (JP); Hiroaki Sato, Tokyo (JP); Katsuyuki Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/123,533

(22) Filed: Apr. 17, 2002

(65) Prior Publication Data

US 2002/0160292 A1 Oct. 31, 2002

(30) Foreign Application Priority Data

Apr. 18, 2001 (JP) ..... 2001-119545
Apr. 10, 2002 (JP) ..... 2002-107487

(51) Int. Cl.
*G03G 21/10* (2006.01)

(52) U.S. Cl. ..... 399/343; 399/123; 430/110.3; 430/108.3; 430/108.1

(58) Field of Classification Search ..... 430/110.3, 430/109.1, 111.4, 109.4; 399/393, 123; 930/110.4, 930/108.1, 125; 222/148
See application file for complete search history.

(56) References Cited

U.S. PATENT DOCUMENTS 3,847,604 A * 11/1974 Hagenbach et al. ..... 430/120
4,879,199 A * 11/1989 Gruber et al. ..... 430/137.11
5,220,390 A 6/1993 Ohtani et al.
5,547,797 A * 8/1996 Anno et al. ..... 430/110.3
5,708,925 A * 1/1998 Kobayashi et al. ..... 399/120
5,851,717 A 12/1998 Tsubuko et al.
6,004,711 A * 12/1999 Bourne et al. ..... 430/106.2
6,077,635 A * 6/2000 Okado et al. ..... 430/110.3
6,291,121 B1 * 9/2001 Hollenbaugh et al. ... 430/108.7
6,517,985 B1 * 2/2003 Takagi et al. ..... 430/110.3
6,529,704 B1 * 3/2003 Kurita et al. ..... 399/390
6,800,412 B1 * 10/2004 Sugiyama et al. ..... 430/108.1
2002/0191983 A1 * 12/2002 Mizuno et al. ..... 399/130

FOREIGN PATENT DOCUMENTS

EP 0 933 685 A1 8/1999
JP 54121130 9/1979
JP 60-123857 7/1985
JP 60123857 A * 7/1985
JP 60131547 A * 7/1985
JP 06148941 A * 5/1994
JP 08190221 A * 7/1996
JP 08292595 A * 11/1996
JP 09160283 A * 6/1997

OTHER PUBLICATIONS

Borsenberger, Paul. Organic Photoreceptors for Imaging Systems. New York: Marcel-Dekker, Inc. (1993) pp. 6-17.*
Grant, Roger & Claire Grant. The Chemical Dictionary. New York: McGraw-Hill, Inc. (1987) p. 105.*

* cited by examiner

*Primary Examiner*—Christopher Rodee
(74) *Attorney, Agent, or Firm*—Rabin & Berdo, PC

(57) ABSTRACT

A toner is used in an image-forming apparatus that incorporates a toner-collecting member. The toner-collecting member collects residual toner on a surface of an image-bearing body. The toner includes a spherical toner having at least a binder resin, and an irregularly-shaped particles mixed with the spherical toner. The irregularly shaped particle has an average diameter in the range of 1–50 μm. The average diameter is 14 to 10% of the diameter of a spot printed by the image-forming apparatus. The irregularly shaped particle is a toner having the same color as the spherical toner. The irregularly shaped particle is a colorless toner. The irregularly shaped particle is charged opposite in polarity to the spherical toner. The irregularly has a roundness of 0.85 or less.

12 Claims, 11 Drawing Sheets

FIG.2

TABLE 1 (PRINTING DUTY CYCLE : 5%)

| TYPE OF TONER | NUMBER OF PAGES THAT CAN BE PRINTED BEFORE INSUFFICIENT CLEANING OCCURS | WHITE LINES |
|---|---|---|
| SPHERICAL TONER ALONE | 2000 | NONE |
| SPHERICAL TONER & SILICONE RESIN (0.1 μM) | 2000 | NONE |
| SPHERICAL TONER & SILICONE RESIN (0.5 μM) | 2000 | NONE |
| SPHERICAL TONER & SILICONE RESIN (1 μM) | NO POOR CLEANING | NONE |
| SPHERICAL TONER & SILICONE RESIN (3 μM) | NO POOR CLEANING | NONE |
| SPHERICAL TONER & SILICONE RESIN (7 μM) | NO POOR CLEANING | NONE |
| SPHERICAL TONER & SILICONE RESIN (30 μM) | NO POOR CLEANING | NONE |
| SPHERICAL TONER & SILICONE RESIN (40 μM) | NO POOR CLEANING | NONE |
| SPHERICAL TONER & SILICONE RESIN (50 μM) | NO POOR CLEANING | NONE |
| SPHERICAL TONER & SILICONE RESIN (60 μM) | NO POOR CLEANING | YES |

FIG.3

TABLE 2 (PRINTING DUTY CYCLE : 25%)

| TYPE OF TONER | NUMBER OF PAGES THAT CAN BE PRINTED BEFORE INSUFFICIENT CLEANING OCCURS | WHITE LINES | ABSENCE OF DOTS FROM PRINTED IMAGE |
|---|---|---|---|
| SPHERICAL TONER ALONE | 2000 | NONE | NONE |
| SPHERICAL TONER & SILICONE RESIN (0.1 μM) | 2000 | NONE | NONE |
| SPHERICAL TONER & SILICONE RESIN (0.5 μM) | 2000 | NONE | NONE |
| SPHERICAL TONER & SILICONE RESIN (1 μM) | 8000 | NONE | NONE |
| SPHERICAL TONER & SILICONE RESIN (3 μM) | NO POOR CLEANING | NONE | NONE |
| SPHERICAL TONER & SILICONE RESIN (7 μM) | NO POOR CLEANING | NONE | NONE |
| SPHERICAL TONER & SILICONE RESIN (10 μM) | NO POOR CLEANING | NONE | NONE |
| SPHERICAL TONER & SILICONE RESIN (20 μM) | NO POOR CLEANING | NONE | NONE |
| SPHERICAL TONER & SILICONE RESIN (30 μM) | NO POOR CLEANING | NONE | YES |
| SPHERICAL TONER & SILICONE RESIN (40 μM) | NO POOR CLEANING | NONE | YES |

FIG.4

TABLE 3 (PRINTING DUTY CYCLE : 5% OR LESS)

| TYPE OF TONER (ROUNDNESS) | NUMBER OF PAGES THAT CAN BE PRINTED BEFORE INSUFFICIENT CLEANING OCCURS |
|---|---|
| SPHERICAL TONER ALONE (0.9 OR HIGHER) | 2000 |
| SPHERICAL TONER & SILICONE RESIN (0.90) | 2000 |
| SPHERICAL TONER & SILICONE RESIN (0.85) | NO POOR CLEANING |
| SPHERICAL TONER & SILICONE RESIN (0.80) | NO POOR CLEANING |
| SPHERICAL TONER & SILICONE RESIN (0.75) | NO POOR CLEANING |
| SPHERICAL TONER & SILICONE RESIN (0.70) | NO POOR CLEANING |
| SPHERICAL TONER & SILICONE RESIN (0.65) | NO POOR CLEANING |
| SPHERICAL TONER & SILICONE RESIN (0.60) | NO POOR CLEANING |
| SPHERICAL TONER & SILICONE RESIN (0.55) | NO POOR CLEANING |
| SPHERICAL TONER & SILICONE RESIN (0.50) | NO POOR CLEANING |
| SPHERICAL TONER & SILICONE RESIN (0.45) | NO POOR CLEANING |
| SPHERICAL TONER & SILICONE RESIN (0.40) | NO POOR CLEANING |
| SPHERICAL TONER & SILICONE RESIN (0.35) | NO POOR CLEANING |
| SPHERICAL TONER & SILICONE RESIN (0.30) | NO POOR CLEANING |

FIG.5

TABLE 4

| PERCENTAGE BY WEIGHT OF SILICONE RESIN TO 100 PARTS BY WEIGHT OF SPHERICAL TONER | NUMBER OF PAGES THAT CAN BE PRINTED BEFORE INSUFFICIENT CLEANING OCCURS | WHITE LINES |
|---|---|---|
| 0.05 | 2000 | NONE |
| 0.1 | NO POOR CLEANING | NONE |
| 0.2 | NO POOR CLEANING | NONE |
| 0.4 | NO POOR CLEANING | NONE |
| 0.6 | NO POOR CLEANING | NONE |
| 0.8 | NO POOR CLEANING | NONE |
| 1 | NO POOR CLEANING | NONE |
| 2 | NO POOR CLEANING | NONE |
| 3 | NO POOR CLEANING | NONE |
| 4 | NO POOR CLEANING | NONE |
| 5 | NO POOR CLEANING | NONE |
| 6 | NO POOR CLEANING | YES |

FIG.6

TABLE 5

| TYPE OF TONER | NUMBER OF PAGES THAT CAN BE PRINTED BEFORE INSUFFICIENT CLEANING OCCURS | WHITE LINES | FIXING TEMPERATURE (℃) |
|---|---|---|---|
| SPHERICAL TONER ALONE | 2000 | NONE | 180 |
| SPHERICAL TONER & SILICONE RESIN (DIAMETER=7 μM) | NONE | NONE | 220 |
| SPHERICAL TONER & IRREGULARLY SHAPED TONER (DIAMETER=8 μM) | NONE | NONE | 180 |

FIG.7

TABLE 6

| TYPE OF TONER | NUMBER OF PAGES THAT CAN BE PRINTED BEFORE INSUFFICIENT CLEANING OCCURS | FIXING TEMPERATURE (℃) |
|---|---|---|
| SPHERICAL TONER ALONE | 2000 | 180 |
| SPHERICAL TONER & SILICONE RESIN (ROUNDNESS=0.85, DIAMETER=8 μM) | NO POOR CLEANING | 220 |
| SPHERICAL TONER & IRREGULARLY SHAPED TONER (ROUNDNESS=0.85, DIAMETER=8 μM) | NO POOR CLEANING | 180 |

FIG.8

TABLE 7

| TYPE OF TONER | NUMBER OF PAGES THAT CAN BE PRINTED BEFORE INSUFFICIENT CLEANING OCCURS | FIXING TEMPERATURE (℃) | ADHESION OF TONER TO BACKGROUND AREA OF IMAGE |
|---|---|---|---|
| SPHERICAL TONER ALONE | 2000 | 180 | FAIR |
| SPHERICAL TONER & SILICONE RESIN (ROUNDNESS=0.85, DIAMETER=8 μM) | NO POOR CLEANING | 220 | FAIR |
| SPHERICAL TONER & CALCIUM CARBONATE (ROUNDNESS=0.85, DIAMETER=5 μM) | NO POOR CLEANING | 180 | GOOD |

FIG.9

TABLE 8

| PERCENTAGE BY WEIGHT OF SILICONE RESIN TO 100 PARTS BY WEIGHT OF SPHERICAL TONER | NUMBER OF PAGES THAT CAN BE PRINTED BEFORE INSUFFICIENT CLEANING OCCURS | WHITE LINES |
|---|---|---|
| 0.05 | 2000 | EXCELLENT |
| 0.1 | NO POOR CLEANING | EXCELLENT |
| 0.2 | NO POOR CLEANING | EXCELLENT |
| 0.5 | NO POOR CLEANING | EXCELLENT |
| 1 | NO POOR CLEANING | EXCELLENT |
| 5 | NO POOR CLEANING | EXCELLENT |
| 10 | NO POOR CLEANING | EXCELLENT |
| 15 | NO POOR CLEANING | EXCELLENT |
| 20 | NO POOR CLEANING | EXCELLENT |
| 25 | NO POOR CLEANING | EXCELLENT |
| 30 | NO POOR CLEANING | EXCELLENT |
| 35 | NO POOR CLEANING | EXCELLENT |
| 40 | NO POOR CLEANING | GOOD |
| 45 | NO POOR CLEANING | GOOD |
| 50 | NO POOR CLEANING | GOOD |
| 55 | NO POOR CLEANING | FAIR |

FIG.10

TABLE 9

| TYPE OF TONER | NUMBER OF PAGES THAT CAN BE PRINTED BEFORE INSUFFICIENT CLEANING OCCURS | WHITE LINES |
|---|---|---|
| SPHERICAL TONER ALONE | 3000 | NONE |
| SPHERICAL TONER & IRREGULARLY SHAPED TONER (DIAMETER=8 $\mu$M) | 5000 | NONE |
| SPHERICAL TONER & REVERSE CHARGED SILICONE RESIN (DIAMETER=8 $\mu$M) | NO POOR CLEANING | NONE |

FIG.11

TABLE 10

| TYPE OF TONER | NUMBER OF PAGES THAT CAN BE PRINTED BEFORE INSUFFICIENT CLEANING OCCURS |
|---|---|
| SPHERICAL TONER ALONE | 3000 |
| SPHERICAL TONER & IRREGULARLY SHAPED TONER (ROUNDNESS=0.85, DIAMETER=8 $\mu$M) | 5000 |
| SPHERICAL TONER & REVERSE CHARGED SILICONE RESIN (ROUNDNESS=0.85, DIAMETER=8 $\mu$M) | NO POOR CLEANING |

TONER, TONER CARTRIDGE THAT HOLDS THE TONER THEREIN, AND IMAGE FORMING APPARATUS INTO WHICH THE TONER CARTRIDGE IS ATTACHED

BACKGROUND OF THE INVENTION

1. Field of the Invention

The present invention relates to toner used in an image-forming apparatus such as a printer and a facsimile that employ electrophotography. The present invention further relates to an a toner cartridge that holds toner therein and an image-forming apparatus to which the toner cartridge is removably attached.

2. Description of the Related Art

Electrophotography involves well-known photographic processes: charging, exposing, developing, transferring, fixing and cleaning. Among the charging devices is a contact type charging device in which an electrically conductive charging roller receives a d-c high voltage and rotates in contact with an image-bearing body. Among the transferring devices is a contact type transferring device in which an electrically semiconductive sponge roller receives a d-c high voltage and transfers a toner image formed on the image-bearing body onto a recording medium.

Charging device and transferring device usually employ a corona charging device, which requires a high voltage source in the range of 5–10 kV. This high voltage source is very expensive.

A corona charging device is required to be immune to environmental changes because the potential of an image-bearing body varies with temperature. In addition, corona discharge generates ozone, which in turn causes the characteristics of an electrostatic latent image-bearing body to deteriorate. In order to prevent deterioration of the characteristics, an ozone-absorbing filter is mounted to the image-forming apparatus to prevent ozone from escaping from the image-forming apparatus. This ozone-absorbing filter has a short life during which the filter can absorb ozone and decompose the absorbed ozone, and therefore should be replaced once in a while. In order to solve the aforementioned drawbacks of a corona charging device, Laid-open Japanese Patent (KOKAI) No. 63-208878, for example, proposes a contact type charging device. According to the publication, an electrically conductive roller having a resistance in the range of $10^5$–$10^6$ Ω is in contact with an electrostatic latent image-bearing body and receives a d-c voltage to charge the surface of the image-bearing body.

Laid-open Japanese Patent (KOKAI) No. 6-19276 proposes a contact type transferring device. According to the publication, an electrically semiconductive sponge roller is employed as a transfer roller and is in contact with an image bearing body with a recording medium sandwiched between the image-bearing body and the transfer roller. The sponge roller receives a d-c voltage to transfer a toner image formed on the surface of the image bearing body onto a recording medium.

One well-known conventional developing device is a two-component magnetic brush developing device. The developing device has a development sleeve with a plurality of magnets that supply a developer material. The developer material includes magnetic powder called "carrier" and a coloring material called "toner" of about 3 to 10 wt %. The developing device requires a toner density sensor for detecting the weight percentage of toner, and a screw and a paddle for mixing and agitating the carrier and the toner. Thus, a developing device is necessarily complex, large, and expensive. The carrier deteriorates over a long time and therefore the carrier replacement is necessary.

In order to solve the drawbacks of the aforementioned two-component magnetic brush developing device, Laid-open Japanese Patent (KOKAI) No. 61-173274 proposes a contact type developing device in which an electrically conductive resilient toner-carrying body i.e., a developing roller having an electrical resistance of less than $10^6$ Ω is in contact with an image-bearing body and receives a d-c voltage to develop the electrostatic latent image formed on the image-bearing body.

A toner-supplying roller formed of an electrically conductive resilient material is in contact with the developing roller to supply the toner held in a toner cartridge.

Japanese Patent (KOKAI) No. 6-19276 proposes a cleaning device that collects residual toner on the image-bearing body, the resilient blade having an edge in contact with the image-bearing body.

However, with the aforementioned image-forming apparatus, the surface of the resilient blade has a roughness of several microns. When spherical toner is used, the toner particles escape through gaps created by the surface having a roughness of about several microns. As a result, the cleaning blade cannot clean the surface of the image bearing body thoroughly.

The edge of a resilient blade is in firm contact with the surface of the image-bearing body during early stage of the lifetime of the printer. Through repetitive printing operations, the edge wears out into a round edge. Therefore, the spherical toner particles easily passes through the contact area where the resilient blade is in contact with the image bearing body, resulting in insufficient cleaning performance.

SUMMARY OF THE INVENTION

An object of the invention is to provide a toner, a toner cartridge that holds toner therein, and an image-forming apparatus to which the toner cartridge is removably attached.

A toner is used in an image-forming apparatus that incorporates a toner collecting member. The toner-collecting member collects residual toner on a surface of an image-bearing body. The toner includes a spherical toner having at least a binder resin, and irregularly shaped particle mixed with the spherical toner.

The irregularly shaped particle has an average diameter in the range of 1–50 μm.

The average diameter is in the range of 14 to 100% of a diameter of a spot printed.

The irregularly shaped particles are toner particles having a same color as the spherical toner particles.

The irregularly shaped particles are colorless particles.

The irregularly shaped particles can be charged.

The irregularly shaped particle has a characteristic that the irregularly shaped particles are charged opposite in polarity to the spherical toner particles.

The irregularly has a roundness of 0.85 or less.

The irregularly shaped toner particles are mixed with the spherical toner by 0.1 to 5 wt %.

A toner cartridge removably is attached to an image-forming apparatus having a toner-collecting member that collects residual toner on an image bearing body. The toner cartridge includes:

a toner chamber;

a spherical toner held in the toner chamber, the spherical toner having at least binder resin; and an irregularly shaped particle mixed with the spherical toner.

An image-forming apparatus having a toner cartridge that holds a toner therein and a toner-collecting member that collects residual toner on an image-bearing body, the toner cartridge includes:

a toner chamber;

a spherical toner held in the toner chamber, the spherical toner having at least a binder resin; and an irregularly shaped particle mixed with the spherical toner.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIGS. 2 and 3 show Tables 1 and 2 that illustrate a first embodiment and list the occurrence of white lines and the number of pages that can be printed before insufficient cleaning results occur.

FIG. 4 shows Table 3 that illustrates the first embodiment and lists the printing results when 10,000 pages were printed continuously at a printing duty cycle of 5%.

FIG. 5 shows Table 4 that lists the results of the experiment in the first embodiment.

FIG. 6 shows Table 5 that illustrates a second embodiment and shows experimental results when 10,000 pages were printed at a printing duty cycle of 5% by using the toner according to the second embodiment.

FIG. 7 shows Table 6 that lists experimental results when 10,000 pages were printed at printing duty cycle of 5% by using the toner 16 in which spherical toner is mixed with irregularly shaped toner having a roundness of 0.85 or less.

FIG. 8 shows Table 7 that lists experimental results when 10,000 pages were printed at a printing duty cycle of 5%.

FIG. 9 shows Table 8 that lists experimental results when irregularly shaped toner is used as irregularly shaped particles.

FIG. 10 shows Table 9 that illustrates experimental results of the third embodiment when printing was performed to print 5,000 pages at a printing duty cycle of 0.1% and subsequently 5,000 pages at a printing duty cycle of 10%; and FIG. 11 shows Table 10 that illustrates the experimental results when printing was performed to print 5,000 pages at a printing duty cycle of 0.1% and subsequently 5,000 pages at a printing duty cycle of 10%.

DETAILED DESCRIPTION OF THE INVENTION

First Embodiment

Figure 1:
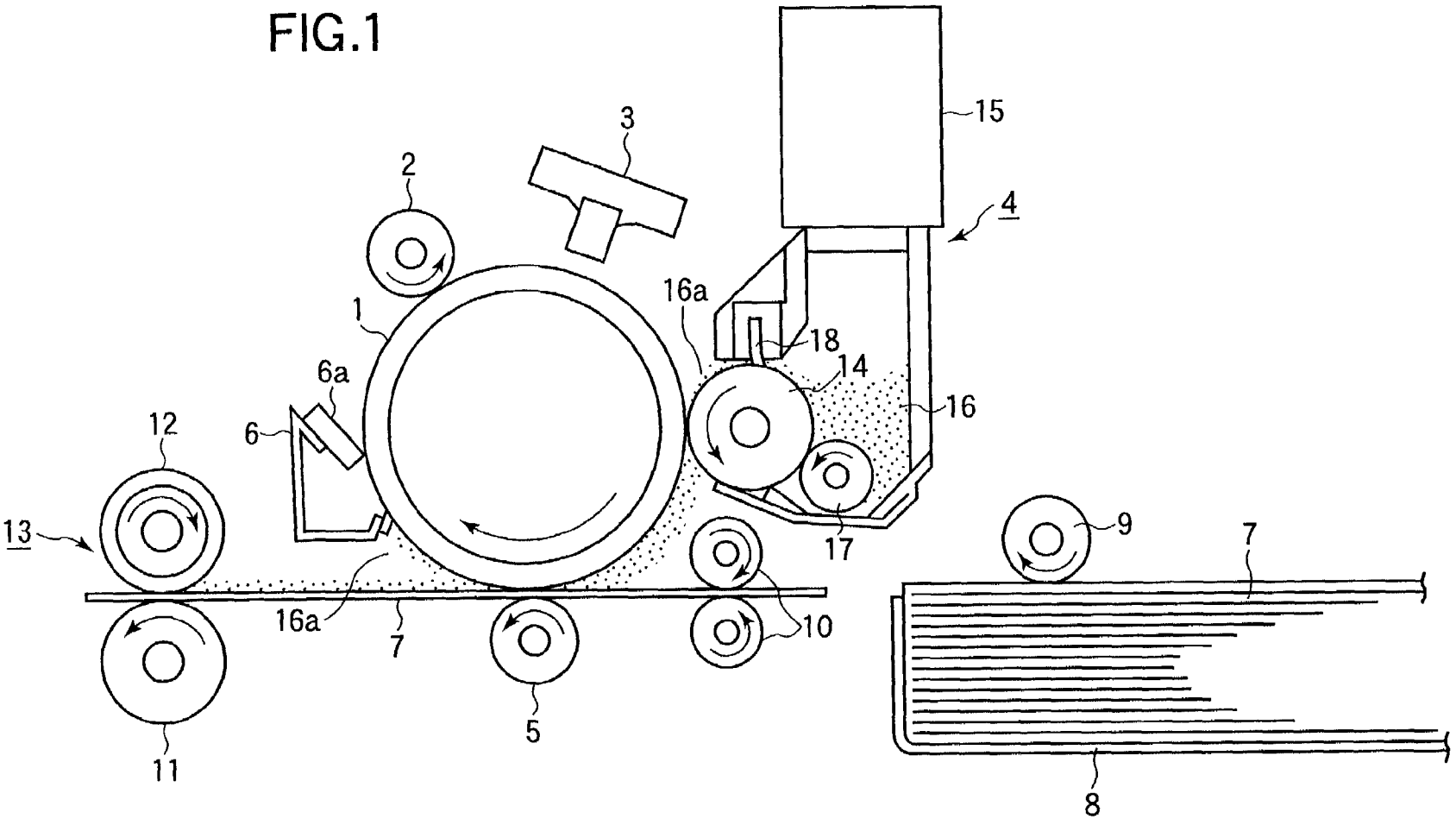
FIG. 1 illustrates a general construction of an image forming apparatus that uses a toner according to the present invention.

FIG. 1 illustrates a general construction of an image-forming apparatus that uses a toner according to the present invention. A photoconductive drum 1 is in the shape of a drum and has an organic photoconductive body formed thereon. The organic photoconductive body functions as an image-bearing body on which an electrostatic latent image is formed. Disposed around the photoconductive drum 1 are a charging roller 2, an exposing unit 3, a developing unit 4, and a transfer roller 5. The charging roller 2, developing unit 4, and transfer roller 5 are in contact with or in pressure contact with the surface of the photoconductive drum 1. The cleaning blade 6*a* is in contact with the surface of the photoconductive drum 1 so that when the photoconductive drum 1 rotates, the cleaning blade 6*a* scrapes the residual toner deposited on the surface of the photoconductive drum 1.

The exposing unit 3 illuminates the charged surface of the photoconductive drum 1 in accordance with an image signal, thereby forming an electrostatic latent image on the photoconductive drum 1. The exposing unit 3 can be of any conventional type such as a combination of an LED array and a SELFOC lens array and a combination of a laser and an image-forming optical system.

The transfer roller 5 opposes the photoconductive drum 1 with a transport path of a recording paper 7 sandwiched between the transfer roller 5 and the photoconductive drum 1. A transporting roller 10 is located upstream of the transport path. A feeding roller 9 feeds the recording paper 7 from a cassette 8 onto the transport path and the transport roller 10 transports the recording paper 7. Downstream of the transport path, there are provided a fixing unit 13 that includes a pressure roller 11 and a heat roller 12.

The developing unit 4 includes a developing roller 14, a toner-supplying roller 17, and a developing blade 18. The developing roller 14 is in contact with the photoconductive drum 1 and functions as a toner-holding body. The toner-supplying roller 17 supplies toner 16 replenished from a cartridge 15 to the developing roller 14. The developing blade 18 is in pressure contact with the surface of the developing roller 14 to form a thin layer of toner thereon.

The developing roller 14, toner-supplying roller 17 and cleaning blade 6*a* are formed of urethane rubber.

A controller, not shown, controls the photoconductive drum 1, charging roller 2, exposing unit 3, transfer roller 5, feeding roller 9, transporting roller 10, pressure roller 11, and heat roller 12.

The controller controls d-c high voltage power supplies, not shown, to apply d-c high voltages to the charging roller 2, transfer roller 5, developing roller 14, and toner-supplying roller 17.

The controller also causes a first motor, not shown, to drive in rotation the photoconductive drum 1, charging roller 2, transfer roller 5, transporting roller 10, pressure roller 11, heat roller 12, developing roller 14, and toner-supplying roller 17. The feeding roller 9 is driven in rotation by a second motor, not shown.

The apparatus according to the present invention will be described with reference to FIG. 1. Upon receiving a print command from a host apparatus, not shown, the controller causes a drive source, not shown, to rotate the photoconductive drum 1, charging roller 2, transfer roller 5, transporting roller 10, pressure roller 11, heat roller 12, developing roller 14, and toner-supplying roller 17 in the direction shown by arrows.

The controller applies a d-c voltage to the charging roller 2 to uniformly charge the surface of the photoconductive drum 1.

Then, the controller controls the exposing unit 3 to illuminate the charged surface of the photoconductive drum 1 in accordance with the image signal. The potential of areas on the photoconductive drum 1 exposed to the light from the exposing unit 3 decreases to about 0 volts, so that the exposed areas form an electrostatic latent image as a whole.

The controller applies a d-c high voltage to the developing roller 14 and toner-supplying roller 17, the d-c high voltage being of the same polarity as that applied to the changing roller 2. The d-c high voltage causes the toner 16 to be charged so that the toner 16 is attracted by the Coulomb force to the electrostatic latent image to become a toner image.

The controller causes the second drive motor to drive the feeding roller 9 in accordance with the timings of a toner-image forming process, thereby advancing one page of the recording paper 7 from the cassette 8 into the transport path. Then, when the recording paper 7 reaches a transfer point where the photoconductive drum 1 comes into contact with the transfer roller 5, the toner image formed on the photoconductive drum 1 reaches the transfer point in a timed relation.

When the recording paper 7 having a toner image transferred thereto passes through a fixing unit 13, the pressure roller 11 and heat roller 12 apply pressure and heat to the recording paper 7 to fuse the toner image on the recording paper 7. After the toner image has been transferred onto the recording paper 7, a small amount of charged toner 16*a* remains on the photoconductive drum 1. A cleaning blade 6*a* removes the residual toner from the photoconductive drum 1. In this manner, the photographic processes are carried out for each page of the recording paper 7.

The manufacture of spherical toner (suspension polymerization toner) and the toner according to the present invention will now be described.

The following materials are put in a powdering machine (Model MA-01SC, manufactured by Mitsui Miike Chemical Industry): 77.5 parts by weight of styrene, 22.5 parts by weight of acrylic acid-N-butyl as a binder resin, 1.5 parts by weight of low molecular weight polyethylene as offset-preventing agent, 2 parts by weight of a charge control agent (Hodogaya Corporation), and 7 parts by weight of carbon black (Printex L, manufactured by Degussa Corporation) and 1 part by weight of 2, 2' azobisisobutyronitrile as a coloring agent. Then, the materials are dispersed at 15° C. for 10 hours into a polymerizable composition. Then, ethanol was prepared in which 8 parts by weight of polyacrylic acid and 0.3 parts by weight of divinylbenzene are dissolved. Then, 600 parts by weight of distilled water is added to the thus prepared ethanol to prepare dispersion medium for polymerization. The previously prepared polymerizable composition is then added to the dispersion medium and dispersed at 15° C. and 8000 rpm for 10 minutes using TK homomixer (M-type, manufactured by TOKUSHU-KAGAKU KOGYO).

Then, the thus dispersed solution is put in a separable flask and allowed to react at 85° C. for 12 hours while agitating in the flow of a nitrogen at 100 rpm. After cooling, the dispersed solution is dissolved in a 0.5 N aqueous solution of hydrochloric acid and then filtered and washed with water, and finally air-dried. Then, the dried material is further dried at a low pressure of 10 mm Hg and 40° C. for 10 hours, and is then air-classified with an air-classifier. Then, 1.0 wt. part hydrophobic ultra fine silica "Aerosil 11R-972" from Aerosil Japan is added to the material and mixed to prepare a spherical toner having an average particle diameter of 7.5 μm and a roundness of 0.9 or greater. Then, the thus prepared spherical toner is mixed with silicone resin as an irregularly shaped particle having a roundness of 0.85 or less, thereby providing the toner 16 according to the present invention. Roundness is expressed by $4\pi S/L^2$ where S is a projected area when a particle is projected onto a two-dimensional plane and L is a peripheral length of the particle.

Particle diameter will be now described.

The diameter of toner particles is measured with a Coulter counter. This apparatus operates on Coulter principle (electrical resistance method) permitted throughout the world and is used to measure the size of particles. In operation, electrode plates are placed on both sides of an aperture of an aperture tube and a direct current voltage is applied across the electrode plates. Then, a certain current flows between the electrode plates, the current being determined primarily by the electrical resistance of the electrolyte and aperture tube. When the current flows between the electrode plates, materials under test suspended in the electrolyte is sucked by a mercury manometer and passes through the aperture, the electrolyte that corresponds to the particle volume is displaced to create a change in electrical resistance between the electrode plates. This change in electrical resistance is converted into a pulse signal, which is amplified for counting the number of the particles and measuring the size of the particles.

The average diameter of irregularly-shaped particles is preferably in the range of 3–20 μm. For printing at a resolution of 1200 dpi, the diameter of a spot printed is 21 μm. In other words, the average diameter should be in the range of 0.14 to 1 of the spot (i.e., resolution, 21 μm).

FIGS. 2 and 3 show Table 1 and Table 2, respectively, which illustrate experimental results of toner used in the first embodiment when printing was performed at a resolution of 1200 dpi by using the aforementioned spherical toner mixed with silicone resin. Table 1 lists the occurrence of white lines and the number of pages that can be printed before insufficient cleaning results occur, the printing (characters) being performed at a printing duty cycle of 5% and the spherical toner being mixed with a silicone resin having an average diameter in the range of 0.1–60 μm. Table 2 lists the occurrence of white lines and the number of pages printed before insufficient cleaning results occur, the printing (graphics) being performed at a printing duty cycle of 25% and the spherical toner being mixed with a silicone resin having an average diameter in the range of 0.1–40 μm.

An irregularly shaped particle has more microscopic recesses and protrusions than a spherical toner particle. The cleaning blade 6*a* has a surface roughness of several microns. Irregularly shaped toner particles are apt to be caught by rough parts of the surface so that the particles are trapped in areas at which the cleaning blade 6*a* abuts the photoconductive drum 1. Thus, the spherical toner particles cannot escape from the areas of the cleaning blade 6*a* in contact with the photoconductive drum 1, and are scraped by the cleaning blade 6*a* from the photoconductive drum 1. Thus, Table 1 implies that irregularly shaped particles having an average diameter of larger than 1 μm do not cause insufficient cleaning.

It should be noted that if irregularly shaped particles are too small, e.g., smaller than 0.5 μm in diameter, then the particles cannot stay at areas where the cleaning blade 6*a* is in contact with the photoconductive drum 1, but pass therethrough.

As a result, both the irregularly shaped particles and spherical toner particles escape from the areas where the cleaning blade 6*a* is in contact with the photoconductive drum 1. Thus, as shown in Table 1, insufficient cleaning occurs after printing 2,000 pages.

If the irregularly shaped particles have an average diameter of 60 μm, the particles of the toner 16 are trapped in the areas where the developing roller 14 is in contact with the developing blade 18, so that thin lines are created in a thin layer of charged toner 16*a* formed on the surface of the developing roller 14 and the thin lines cause white lines in an image printed on the recording paper 7. Thus, when printing is performed at a printing duty cycle of 5%, the toner 16 should contain spherical toner particles mixed with irregularly shaped particles having an average diameter in the range of 1–50 μm.

The roughness of the edge of the cleaning blade 6*a* and the surface of the photoconductive drum 1 vary with time and depending on printing duty cycle. Thus, the number of pages that can be printed without insufficient cleaning actually varies.

As mentioned above, insufficient cleaning will not occur in printing, for example, characters, even if the spherical toner particles are mixed with the irregularly shaped particles having an average diameter in the range of 1–50 μm. However, if graphic images are printed frequently, the use of spherical toner particles that are merely mixed with irregularly shaped particles having an average diameter in the range of 1–50 μm will cause insufficient cleaning.

As shown in Table 2, when printing is performed with a printing duty of 25%, deterioration of toner is accelerated. In other words, irregularly shaped particles having an average diameter of 1 μm provide sufficient print quality for ordinary printing, but causes print quality that reflects some insufficient cleaning effect after printing 10,000 pages. For this reason, the average diameter of irregularly shaped particles is preferably 3 μm or larger.

The irregularly shaped particles having an average diameter in the range of 0.1–40 μm do not cause white lines in images printed on the recording paper 7. The irregularly shaped particles having an average diameter of 30 μm or larger causes absence of dots from printed images.

The absence of dots is due to the fact that the irregular particle is large in diameter compared to a printed spot and therefore the toner particle cannot land on an area occupied by the spot.

It can be concluded from Tables 1 and 2 that the average diameter of the irregularly shaped particle is preferably from 3 μm to the diameter of a spot.

According to the first embodiment, insufficient cleaning and white lines can be prevented by using toner 16 in which irregularly shaped particles are mixed with spherical toner particles that include at least a binder resin and a coloring agent. The use of toner having a preferred average diameter ranging from 3 μm to the diameter of a spot can prevent insufficient cleaning and the absence of dots from an image printed when printing is performed at a high printing duty cycle.

An irregularly shaped toner particle having a roundness of 0.85 or less has more microscopic recesses and protrusions than a spherical toner particle. The cleaning blade 6*a* has a surface roughness of several microns. The irregularly shaped particles are apt to be caught by rough parts of the surface so that the particles are trapped in areas at which the cleaning blade 6*a* abuts the photoconductive drum 1. Thus, spherical toner particles cannot escape from the areas but can be scraped from the photoconductive drum 1.

Printing results will now be described for different values of roundness of irregularly shaped particles.

FIG. 4 shows Table 3 that lists the printing results when 10,000 pages were printed continuously at a printing duty cycle of 5%. The toner 16 used in the experiment was prepared by adding irregularly shaped particles (silicone resin) having a roundness in the range of 0.3 to 0.90 to spherical toner particles having a roundness of 0.9 or higher manufactured by suspension polymerization. According to Table 3, when 10,000 pages are printed continuously using irregularly shaped particles having roundness in the range of 0.3 to 0.85, no insufficient cleaning occurs. For the toner 16 that contains irregularly shaped particles having a roundness of 0.9 and higher, insufficient cleaning occurs after printing 2000 pages. In other words, mixing the irregularly shaped particles having a roundness of 0.85 or less provides good cleaning operation though spherical toner is used, and thus provides a wider range of choice of toner shapes.

Printing results will now be described for different amounts of irregularly shaped particles added to the spherical toner particles. An experiment was conducted by using a toner in which 0.1–5 parts by weight of silicone resin as irregularly shaped particles (8 μm) were added to 100 parts by weight of spherical toner.

FIG. 5 shows Table 4 that lists the results of the experiment.

From Table 4, it can be concluded that the irregularly shaped particles should be in the range of 0.1 to 5 wt %. An amount of 0.05% wt % or less causes prominently insufficient cleaning results. An amount of 0.1 wt % will not cause insufficient cleaning and maintains good print result. An amount of 6 wt % or more does not cause insufficient cleaning but irregularly shaped particles stay at the developing blade 18, causing white lines in the print result. A similar result was obtained by using calcium carbonate as an irregularly shaped particle in place of silicone resin.

Second Embodiment

The silicone resin used in the first embodiment has a higher melting point than the spherical toner. Thus, the toner 16 of the first embodiment requires a higher fixing temperature. A second embodiment differs from the first embodiment in that irregularly shaped particles take the form of irregularly shaped toner of the same color as the spherical toner. The image-forming apparatus used in the second embodiment is the same as that used in the first embodiment.

Irregularly shaped toner particles used in the second embodiment will be described. A mixture of the following materials was prepared: 100 parts by weight of polyester resin (number average molecular weight Mn—3700, glass transition point Tg—62° C.) as an organic material, 4.5 parts by weight of carbon black as a colorant, 2.5 parts by weight of a charge control agent, and 1 part by weight of R972 as an additive (from Aerosil Japan). The mixture was agitated and blended well in a Henschel mixer and then heated to melt in a roll mill at 120° C. for about 3 hours. The material was cooled, then ground, and finally classified, thereby preparing irregularly shaped toner having a roundness of 0.85 and the same color (black) as the spherical toner.

The aforementioned irregularly shaped toner is black toner. Toners of other colors can be manufactured by using various colorants. The colorants used in the present invention may be any type of toner colorants including dyes, pigments and others that are usually used as a colorant for toner. The colorants includes various types of carbon black, brilliant first scarlet, phthalocyanine blue, nigrosine, pigment green B, rhodamine B base, permanent brown FG, solvent red 49, and mixtures of these colorants. The various types of carbon black are manufactured by methods such as acetylene black, thermal black, channel black, and lamp black. Graft carbon black is prepared by covering the surfaces of carbon black particles with a resin.

FIG. 6 shows Table 5 that illustrates experimental results when 10,000 pages were printed at a printing duty cycle of 5% by using the toner according to the second embodiment. Table 5 lists the number of pages that can be printed before insufficient cleaning occurs and the occurrence of white lines (1) when spherical toner alone is used, (2) when a mixture of spherical toner and silicone resin (7 μm) was used, (3) when a mixture of spherical toner and irregularly shaped toner (8 μm) of the same color as the spherical toner was used.

When spherical toner alone was used, insufficient cleaning occurred after printing 2000 pages but white lines did not occur, and the fixing temperature was 180° C. When a mixture of spherical toner and silicone resin (7 μm) was used, the fixing temperature was 220° C. When a mixture of spherical toner and irregularly shaped toner (8 μm) of the same color as the spherical toner was used, the fixing temperature was 180° C.

Thus, the toner 16 according to the second embodiment is a mixture of spherical toner and irregularly shaped toner of the same color as the spherical toner.

In the second embodiment, while the irregularly shaped toner was the same color as the spherical toner, the irregularly shaped toner may be colorless. Especially for color printing, irregularly shaped colorless toner may be applied commonly to the respective colored toners, being advantageous in reducing the manufacturing cost of toner for color printer.

The colorless irregularly shaped toner can be manufactured by simply not adding any colorant.

According to the second embodiment, the irregularly shaped toner is mixed with the spherical toner, thereby implementing low fixing temperature as compared to the first embodiment. A saving in electric power may be obtained by using the toner according to the second embodiment.

Print quality was evaluated using the toner 16 in which spherical toner is mixed with irregularly shaped toner that is of the same color and has a roundness of 0.85 or less.

Just as in the first embodiment, FIG. 7 shows Table 6 that lists experimental results when 10,000 pages were printed at printing duty cycle of 5% by using the toner 16 in which spherical toner is mixed with irregularly shaped toner having a roundness of 0.85 or less. Insufficient cleaning did not occur. Use of irregularly shaped toner as irregularly shaped particles provides low fixing temperature. In other words, a resilient rubber blade can be used to perform a sufficient cleaning operation if the toner 16 is prepared by mixing spherical toner with irregularly shaped toner having a roundness of 0.85 or less. Moreover, fixing can be performed at lower temperatures when the spherical toner is mixed with the irregularly shaped toner than when the spherical toner is mixed with silicone resin. Thus, the shape of toner particle can be selected from a wider range and electric power can be saved in fixing.

In the second embodiment, while an organic material (polyester) was used to manufacture irregularly shaped particles, an inorganic material (calcium carbonate) may also be used.

FIG. 8 shows Table 7 that lists experimental results when 10,000 pages were printed at a printing duty cycle of 5%. Calcium carbonate is white and therefore not detectable even if the toner 16*a* adheres to a background area of an image on the photoconductor, so that overall printing quality is good. Mixing calcium carbonate having a roundness of 0.85 can prevent occurrence of insufficient cleaning result even when 10,000 pages are printed continuously. Use of calcium carbonate that functions as irregular particles reduces adhesion of the toner 16*a* to the background area of an image on the photoconductive drum 1, thereby providing good print quality.

FIG. 9 shows Table 8 that lists experimental results when irregularly shaped toner is used as irregularly shaped particles. From Table 8, irregularly shaped toner does not cause white lines but deteriorates print quality. Spherical toner is mixed in the toner 16 because the spherical toner provides a better printing result than irregularly shaped toner. If the toner 16 contains irregularly shaped toner by more than 50%, it is not worthwhile to mix the spherical toner. Thus, the irregularly shaped toner contained in the toner 16 should preferably be in the range of 0.1–50%. If the toner 16 contains the irregularly shaped toner by less than 40%, the presence of the irregularly shaped toner does not affect print quality at all. Thus, preferred content of the irregularly shaped toner is in the range of 0.1–40%.

Third Embodiment

The image forming apparatus used in a third embodiment is the same as that used in the first embodiment. The third embodiment differs from the first embodiment in that irregularly shaped particles take the form of silicone resin (8 μm) that is charged opposite in polarity to the spherical toner.

In the first and second embodiments, when printing is performed continuously at a very low printing duty cycle (e.g., the print result is almost white paper), the irregularly shaped particles escape from areas where the cleaning blade 6*a* is in contact with the photoconductive drum 1. When printing is performed subsequently at a higher printing duty cycle, insufficient cleaning may occur.

FIG. 10 shows Table 9 that illustrates experimental results of the third embodiment when printing was performed to print 5,000 pages at a printing duty cycle of 0.1% and subsequently 5000 pages at a printing duty cycle of 10%. Table 9 lists the number of pages that can be printed before insufficient cleaning occurs and the occurrence of white lines, for (1) the toner 16 containing spherical toner alone, (2) the toner 16 containing the spherical toner and the irregularly shaped toner (8 μm), and (3) the toner containing silicone resin (8 μm) that is charged opposite in polarity to the spherical toner.

When the toner 16 contains the spherical toner alone, insufficient cleaning occurred after printing 3000 pages. When the toner 16 contains the spherical toner and the irregularly shaped toner (8 μm), insufficient cleaning occurred after printing 5000 pages. When the toner 16 contains the spherical toner and silicone resin (8 μm) that is charged opposite in polarity to the spherical toner, no insufficient cleaning occurred. No white line occurred for any of the three different types of toner 16.

Thus, the toner 16 according to the third embodiment employs silicone resin (8 μm) that can be charged opposite in polarity to the spherical toner.

According to the third embodiment, a mixture of the spherical toner with the irregular toner prevents the residual toner on the surface of the photoconductive drum 1 from escaping areas in which the cleaning blade is in contact with the photoconductive drum, even when printing is performed at a low printing duty cycle.

In the third embodiment, the irregularly shaped particle has a charging characteristic in which the irregularly shaped particle is charged opposite in polarity to the spherical toner. However, the same effect may be obtained by using irregularly shaped particle that is charged to the same polarity as the spherical toner, provided that the irregularly shaped particle is charged less than the spherical toner.

Another experiment was conducted to print using the toner 16 that contains irregularly shaped particles that are charged opposite in polarity to the spherical toner and have a roundness of 0.85 or less.

FIG. 11 shows Table 10 that illustrates the experimental results when printing was performed to print 5,000 pages at a printing duty cycle of 0.1% and subsequently 5000 pages at a printing duty cycle of 10%. The irregularly shaped particles are deposited to areas not illuminated by the exposing unit 3 even when printing is performed at a low printing duty cycle. Thus, the toner 16 containing irregularly shaped particles that are charged opposite in polarity to the spherical toner allows the irregularly shaped particles to be supplied to the cleaning blade 6*a*. Therefore, no insufficient cleaning occurs when printing is performed at a low printing duty cycle.

While the aforementioned embodiments have employed an organic photoconductor as an electrostatic latent image-bearing body, the image bearing body may be other photoconductors such as selenium photoconductor, ZnO photoconductor, amorphous silicone photoconductor.

While the toner 16 according to the present invention is based on suspension polymerization toner that has styrene acrylic as a binder resin, the toner may be based on other type of spherical toner that uses other binder resin.

The first to third embodiments provide the same advantages for both two-component development and magnetic one-component development.

The developing roller, toner-supplying roller, and cleaning roller are formed of urethane as a rubber material throughout the first to third embodiments. Alternatively, these rollers may be formed of other rubber materials such as stylene-butadiene polymerizate rubber, acrylonitrile-butadiene rubber, acrylic elastomer, epichlorohydrin rubber, silicone rubber, EPDM, NBR, and blended materials of at least two of these rubber materials.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A toner cartridge removably attachable to an image-forming apparatus having a toner collecting member that collects residual toner on an image bearing body, comprising:

a toner chamber;

spherical toner particles held in said toner chamber, said spherical toner particles being comprised of a binder resin; and irregularly shaped particles formed only of silicone resin, and having a melting point that is higher than a melting point of said spherical toner particles, and being mixed with said spherical toner particles, said irregularly shaped silicone resin particles having an average diameter in the range of 1–50 μm.

2. The toner cartridge according to claim 1, wherein said irregularly shaped particles are adapted to be charged.

3. The toner cartridge according to claim 2, wherein said irregularly shaped particles are charged to have a polarity that is opposite to a polarity of said spherical toner particles.

4. The toner cartridge according to claim 1, wherein said irregularly shaped particles have a roundness equal to or less than 0.85.

5. The toner cartridge according to claim 1, wherein said irregularly shaped particles are mixed with said spherical toner particles by 0.1 to 5 wt %.

6. The toner cartridge according to claim 1, wherein the average diameter of said irregularly shaped particles is about 3 to 20 μm.

7. The toner cartridge according to claim 1, wherein said spherical toner particles further comprise a suspension polymerization toner.

8. A toner cartridge removably attachable to an image-forming apparatus having a toner collecting member that collects residual toner on an image bearing body, comprising:

a toner chamber;

spherical toner particles held in said toner chamber, said spherical toner particles being comprised of a binder resin and having a roundness greater than 0.9; and irregularly shaped white particles comprised of calcium carbonate, and being mixed with said spherical toner particles, said irregularly shaped white particles having an average diameter in the range of 1–50 μm and a roundness equal to or less than 0.85.

9. The toner cartridge according to claim 8, wherein said irregularly shaped particles are mixed with said spherical toner particles by 0.1 to 50 wt %.

10. The toner cartridge according to claim 9, wherein said irregularly shaped particles are mixed with said spherical toner particles by 0.1 to 40 wt %.

11. The toner cartridge according to claim 8, wherein said spherical toner particles further comprise a suspension polymerization toner.

12. The toner cartridge according to claim 8, wherein the average diameter of said irregularly shaped particles is about 3 to 20 μm.

* * * * *